United States Patent [19]

Augustine

[11] Patent Number: 4,815,742

[45] Date of Patent: Mar. 28, 1989

[54] MULTI-LAYERED PUZZLE

[76] Inventor: Lee A. Augustine, 1147 Harrison St., Shakopee, Minn. 55379

[21] Appl. No.: 125,789

[22] Filed: Nov. 20, 1987

Related U.S. Application Data

[63] Continuation-in-part of Ser. No. 917,360, Oct. 9, 1986, abandoned.

[51] Int. Cl.[4] ..... A63F 9/12

[52] U.S. Cl. ..... 273/157 A

[58] Field of Search ..... 273/157 R, 157 A

[56] References Cited

U.S. PATENT DOCUMENTS

| | | | |
|---|---|---|---|
| 2,037,966 | 4/1936 | Dailey | 273/157 R |
| 3,107,918 | 10/1963 | Edlen | 273/157 A UX |
| 3,682,479 | 8/1972 | Miller et al. | 273/157 R |
| 4,336,020 | 6/1982 | Zacharin | 273/157 R X |

FOREIGN PATENT DOCUMENTS

| | | | |
|---|---|---|---|
| 621701 | 4/1949 | United Kingdom | 273/157 A |
| 650175 | 2/1951 | United Kingdom | 273/157 R |
| 743749 | 6/1956 | United Kingdom | 273/157 A |

*Primary Examiner*—Anton O. Oechsle

*Attorney, Agent, or Firm*—Paul L. Sjoquist

[57] ABSTRACT

A multi-layered puzzle having a plurality of generally transparent layers with each layer having different designs thereon. The puzzle is solved by matching the shape design of each piece and identifying the appropriate layer in the puzzle. The overlaying pieces provide for a three dimensional puzzle especially adapted for puzzles having nature scenes inscribed thereon. The difficulty of the puzzle may further be increased by having one or more layers in contoured relation to each other.

2 Claims, 6 Drawing Sheets

MULTI-LAYERED PUZZLE

This is a continuation-in-part of co-pending application Ser. No. 917,360, filed on Oct. 9, 1986, abandoned.

BACKGROUND OF THE INVENTION

The present invention relates to puzzles, and more particularly to puzzles having multiple layers.

In some respects the present invention is similar to U.S. Pat. No. 3,107,918 issued to Edlen on Oct. 22, 1963. The Edlen patent discloses a puzzle having a contoured frame section requiring the matching of a single layer of puzzle pieces with the coutoured back section.

Other commonly available puzzles are likewise single layer puzzles having irregularly shaped pieces. Solving these puzzles requires the placement of pieces which have corresponding shapes and designs in the appropriate location. The present invention requires the further step of determining the appropriate layer for each piece along with locating the corresponding shape or design for each puzzle piece. A further, more difficult puzzle will combine the use of the contours disclosed in the Edlen with the use of multiple layers to provide a puzzle which requires the coordination of multiple surfaces to solve the puzzle.

SUMMARY OF THE INVENTION

An object of the invention is to provide a puzzle that is challenging to solve.

Another object of the invention is to provide a puzzle which is three dimensional and aesthetically pleasing when solved.

A feature of the invention is the provision of multiple layers of puzzle pieces, each layer having a distinct design or picture thereon. When the entire puzzle is solved, the composite layers will form a three dimensional scene which may be framed or form part of a table top.

The frame of the puzzle is preferably constructed of wood or plastic and consists of a back section and attached raised side sections. The back section preferably includes a background design imprinted thereon to form the bottom scene upon which the puzzle pieces are placed. The puzzle pieces are irregularly cut from multiple layers of transparent materials such as PLEXIGLAS, a thermoplastic, usually transparent, polymer of methyl methacrylate. Each layer has a distinct design or color imprinted thereon. Areas of each layer will be transparent without any design thereon to enable the design of a lower positioned layer to be seen in the composite puzzle. Additionally, certain areas of each layer may contain various shades or colors which when combined with the color or design of another layer will be shown on the composite puzzle as a third color.

A further variation of the multi-layered puzzle is the inclusion of one or more layers of contoured puzzle pieces. This variation will increase the difficulty of solving the puzzle and will provide a more aesthetically pleasing finished puzzle.

An advantage of the present invention is that it may form a variety of three dimensional scenes.

Another advantage of the present invention is that it will be durable and inexpensive to manufacture.

Another advantage of the present invention is that when the puzzle is solved it may be mounted on a wall or in a table.

DETAILED DESCRIPTION OF THE PREFERRED EMBODIMENT

Figure 1:
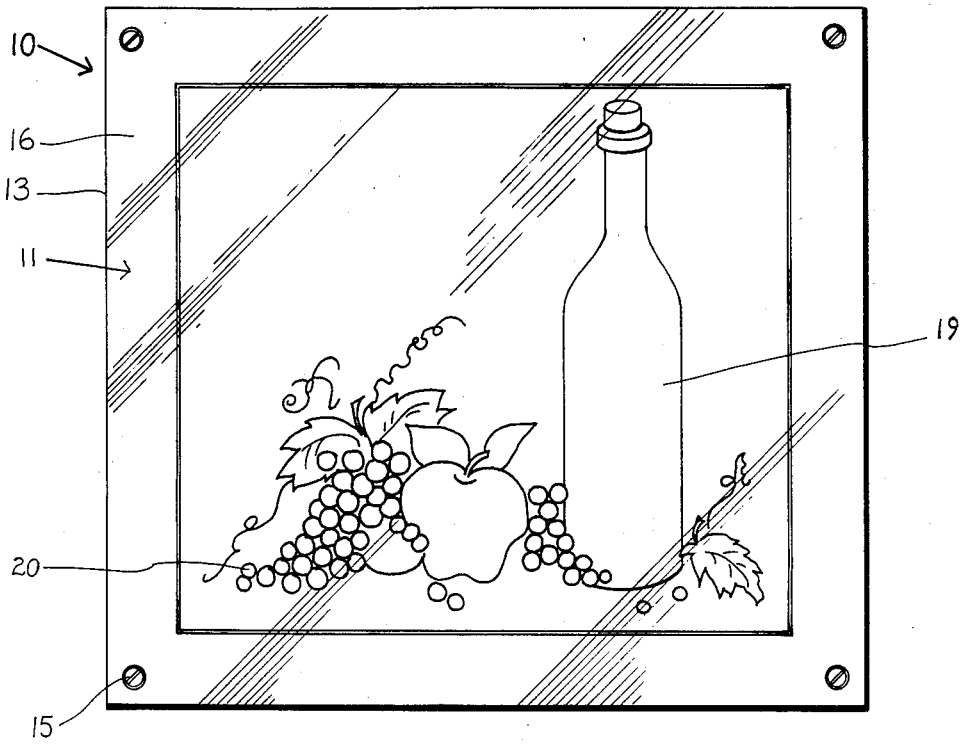
FIG. 1 is a front elevation view of the multi-layered puzzle.
Figure 2:
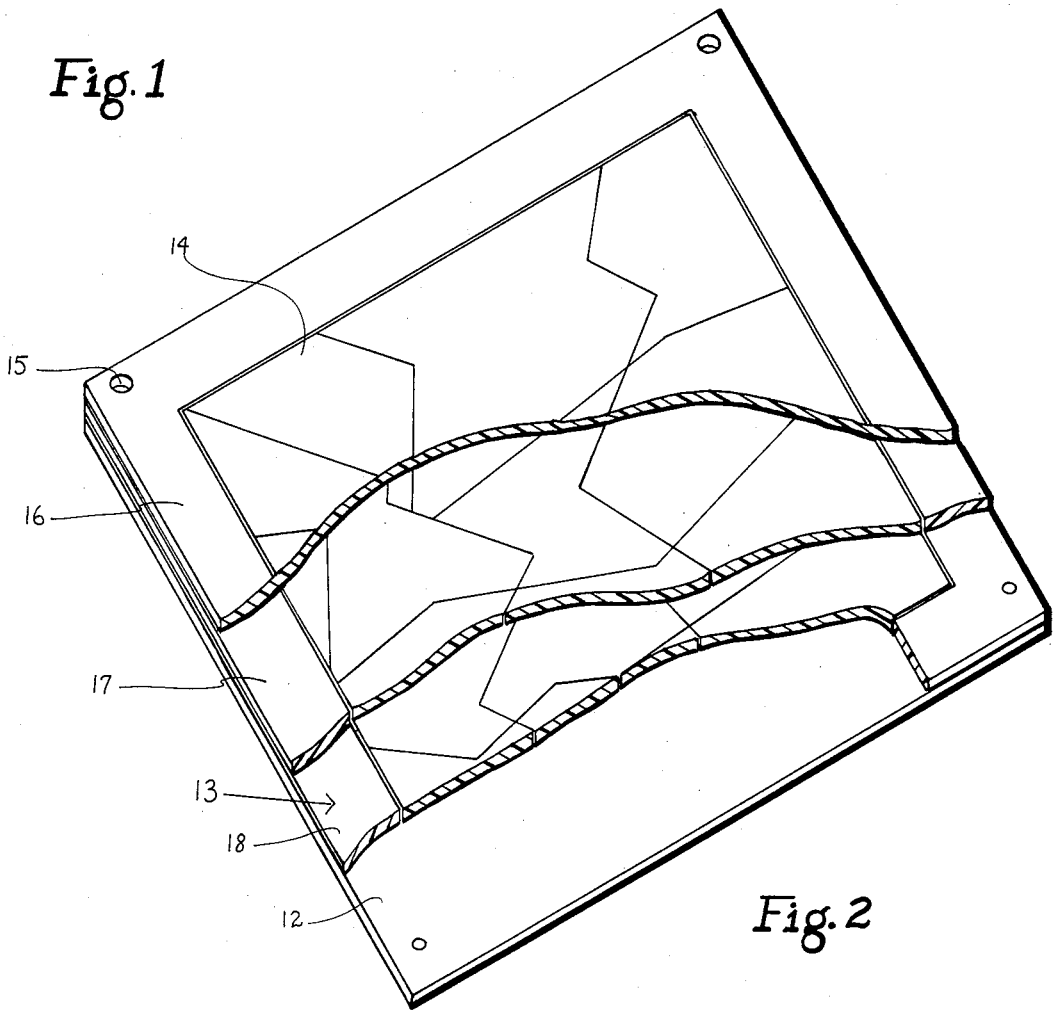
FIG. 2 is a cross sectional view of FIG. 1 illustrating the multiple layers of the puzzle.
Figure 3:
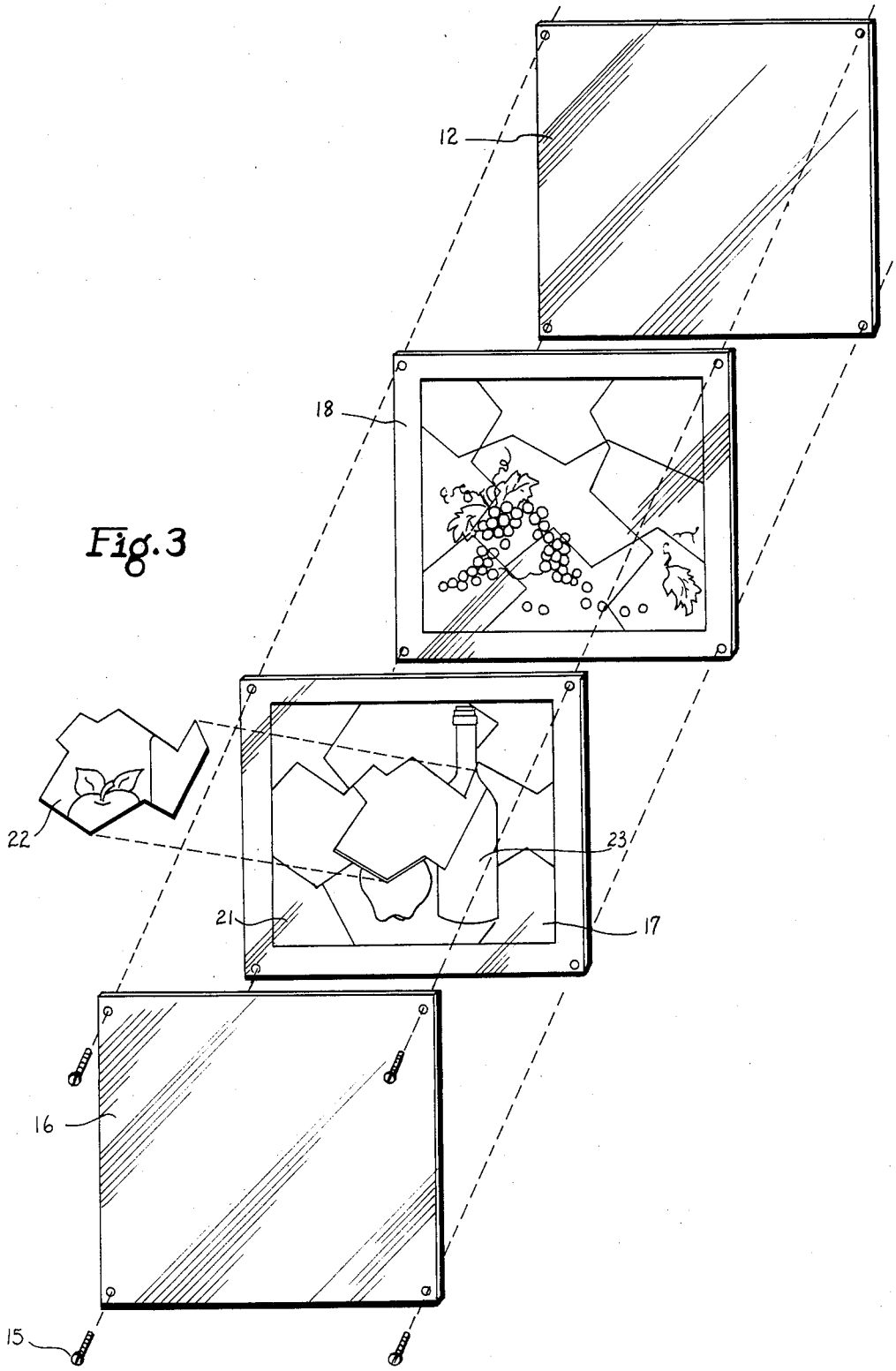
FIG. 3 is an exploded view of the invention illustrating the designs on each layer of the puzzle illustrated in FIG. 1.
Figure 4:
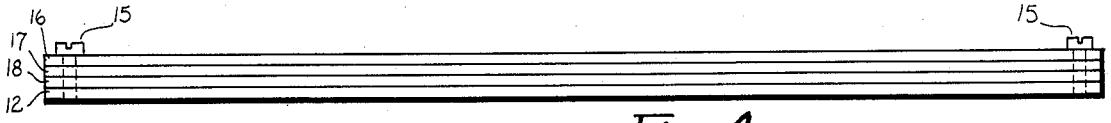
FIG. 4 is a side view of the multi-layered puzzle.

FIGS. 1–3 illustrate the preferred embodiment in a three layered puzzle referred to generally as 10. The puzzle consists of the frame 11 having back section 12 and sides 13 surrounding the puzzle pieces 14. The puzzle 10 may consist of several layers of transparent material and may include a multi-layered frame 11 which is assembled with bolts 15 or other fasteners. Additionally a clear top layer 16 may be used to overlay the puzzle 10 and frame 11 when it is stored or moved.

FIG. 2 illustrates the multiple layers of the puzzle 10. The top layer is referred to generally as 16 and encloses the entire puzzle 10. The second layer is referred to generally as 17 and in our preferred embodiment includes the bottle and apple designs thereon. The third layer is referred to generally as 18 and in our preferred embodiment includes the grape and leaf designs thereon. The final layer is the back section 12 of the frame 11 and may include a further background design or color on its surface. It is anticipated that the back section 12 may be made with a contoured surface to increase the difficulty of solving the puzzle. If the contoured back section 12 is used, the third layer 18 will include matching contours, or in some embodiments, may include portions which are open to require that a piece from the second layer 17 be matched to the contour of the back section 12.

FIG. 3 illustrates the overlapping of the various designs on each layer. In our preferred embodiment, the bottle 19 of the second layer 17 is illustrated overlaying the grapes 20 of the third layer 18. It is further apparent that various colors may be overlayed on the respective layers to provide a different color or design when viewed on the finished puzzle 10.

The puzzle pieces 14 are cut in irregular and interlocking shapes from a piece of transparent plastic which has the desired designs embossed thereon. The various layers will have pieces which are entirely transparent 21, include a partial design 22 or contain the entire design 23 for each layer.

The difficulty in solving the puzzle 10 may be increased by using more layers; a more complex design or by using a contoured layer to increase the dimensional complexity of the puzzle.

Figure 5:
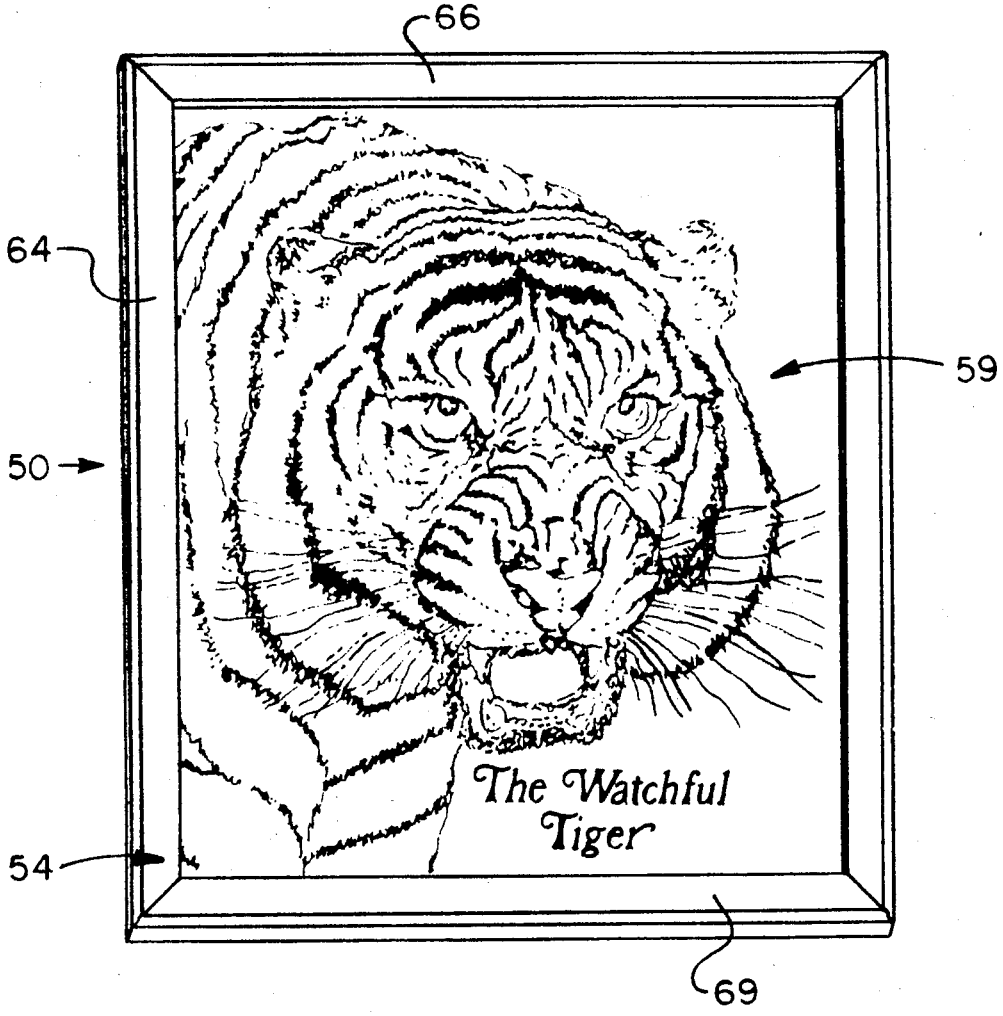
FIG. 5 is a front elevation view of the multi-layered puzzle.
Figure 6:
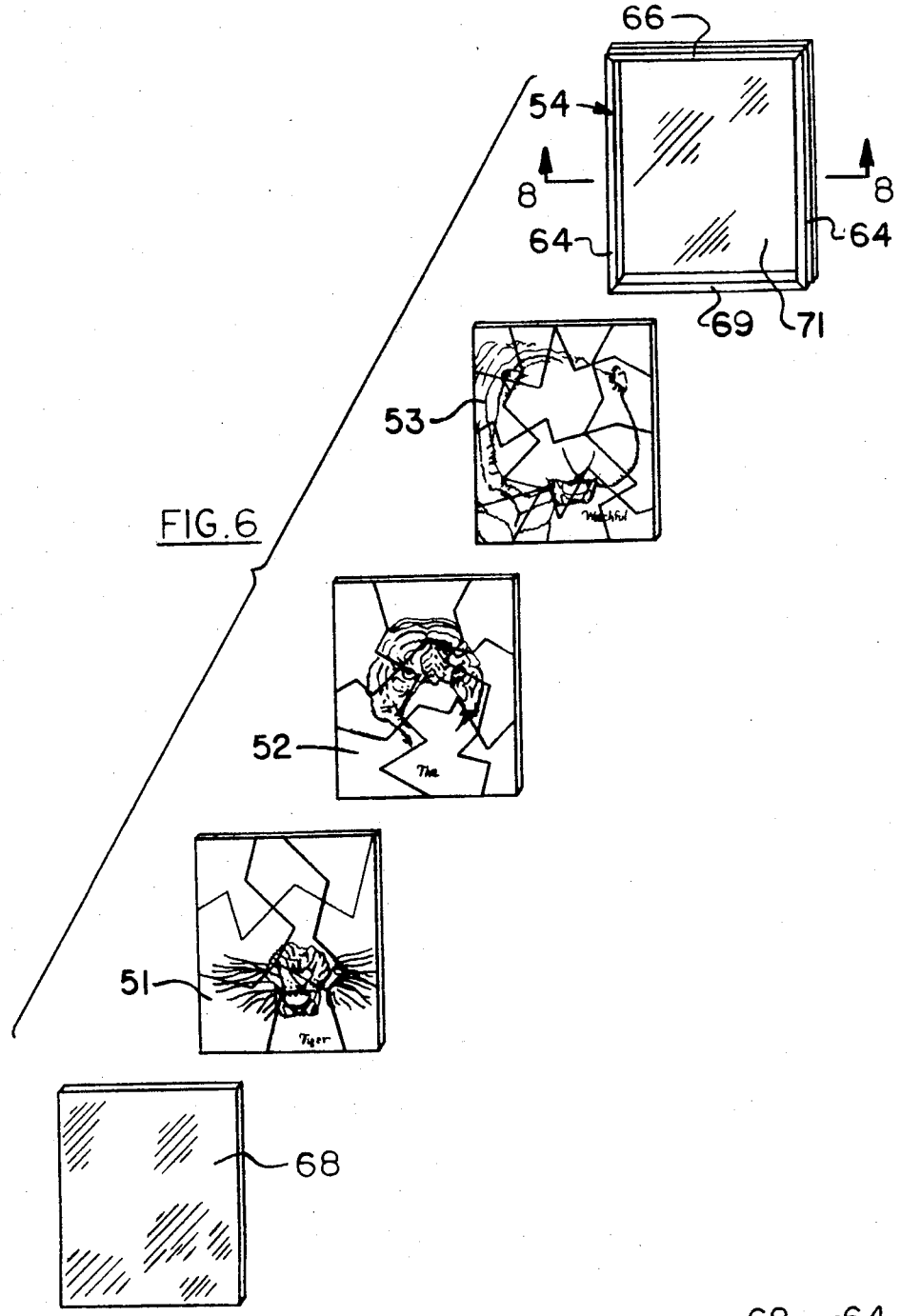
FIG. 6 is an exploded perspective view of the puzzle illustrated in FIG. 5.

FIGS. 5 and 6 illustrate a second preferred embodiment of the present invention. The multilayered puzzle is referred to herein generally as 50. This embodiment utilizes the multi-layered concept disclosed in FIGS. 1–4 and illustrates the use of multiple layers of transparent material having a design silk screened on each individual layer. FIG. 6 is an exploded view of the multilayered puzzle illustrated in FIG. 5. FIG. 6 includes three intermediate layers, 51, 52 and 53, respectively. The puzzle frame 54 is also illustrated and consists of a base section, sides and a cover layer all of which are more fully described below.

In this second embodiment, the illustration of a Tiger is divided into three layers by determining the respective three dimensional location of the features of a Tiger. Therefore, as illustrated in FIG. 6, the word "Tiger" along with the nose and whisker area of the Tiger are imprinted on the top intermediate layer 51 of the puzzle by silk screening the design onto the lower surface of a layer of transparent material. Masking tape (not shown) is then applied to both sides of the transparent material and the transparent material is cut with a laser along a predetermined pattern to form puzzle pieces of a desired shape. In the commercial form of this invention, the masking tape remains on the puzzle pieces until it is removed by the consumer. The masking tape protects the silk screened design from damage which may occur during the shipping and transport of the product to the store.

The second intermediate layer 52 of this embodiment consists of the word "the" along with the eyes and skull area of the Tiger. As with the top intermediate layer 51, the second intermediate layer 52 is preferably made of transparent material. The selected portion of the Tiger's design is then silk screened onto the lower surface of the second intermediate layer 52. Masking tape (not shown) is then applied to both surfaces of the transparent material layer. The transparent material is then cut with a laser along with a predetermined pattern which in the advanced versions of this puzzle will be nearly identical to the cutting pattern used for the top intermediate layer 51. The masking tape will once again remain on the puzzle pieces until it is removed by the consumer.

The third intermediate layer 53 of this embodiment consists of the the word "watchful" along with the shoulder, neck and lower jaw portion of the Tiger. As with the top intermediate layer 51, the third intermediate layer 53 is preferably made of transparent material. The selected portion of the Tiger's design is silk screened onto the lower surface of this third intermediate layer 53. Masking tape (not shown) is then applied to both surfaces of the transparent material. The transparent material is then cut with a laser along a predetermined pattern which may or may not vary from the pattern used in cutting the top or second intermediate layers, 51 and 52 respectively.

Figure 7:
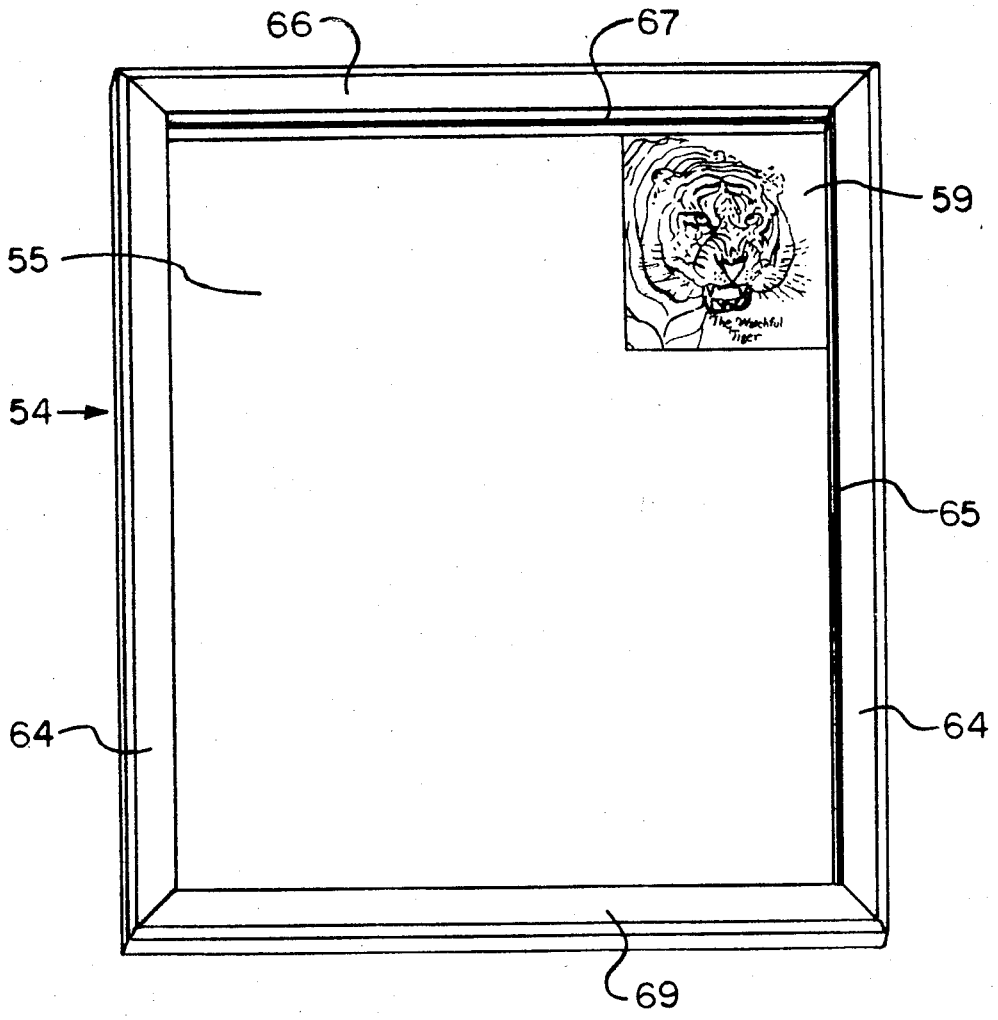
FIG. 7 is an elevational view illustrating one embodiment of the puzzle base layer having a design imprinted thereon.

FIG. 7 illustrates the alternate use of a base section 55 of the puzzle frame 54 having the composite puzzle design 59 imprinted thereon. As with the individual puzzle layers, 51, 52 and 53, the composite design 59 on the base section 55 is preferably applied thereon by silk screening, however, it may be printed thereon by using other conventional printing methods. The addition of the composite design 59 to the base section 55 aids in the completion of the puzzle by providing an illustration of the final design of the puzzle while the puzzle is being assembled. This format will be used on puzzles designed primarily for beginners although it is readily apparent that one of the intermediate layers could be colored or designed so as to block out the composite design 59 on the base section 55. Masking tape would not be place on this base section 55 because it is not intended to be cut by a laser. The challenge to the assembler of a puzzle utilizing this type of embodiment would be primarily to determine the respective layer for each puzzle piece.

Figure 8:
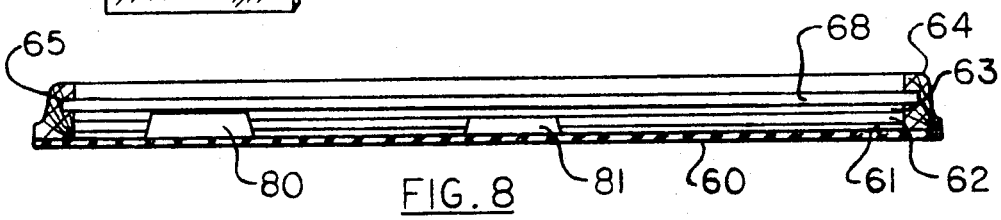
FIG. 8 is a cut-away side view of the multi-layered puzzle illustrating the use of a contoured base layer.

Referring to FIG. 8, a further variation of the multilayered puzzle is illustrated. In this variation, base layer 60 is contoured and extends upwardly through one or more intermediate layers, 61, 62 or 63 respectively. As with the embodiments illustrated in FIGS. 5 and 6, the intermediate layers include three-dimensional designs silk screened thereon. An example of the use of the contoured base layer 60, with the Tiger design would be to have the nose or teeth portions of the design imprinted on contours 80 and 81, respectively. This will add a further three-dimensional effect to the composite puzzle. The contours 80 and 81 are preferably cut from one or more of the intermediate layers by using the laser as previously described and then permanently affixed to the base layer 60 by gluing the piece permanently thereto.

Figure 9:
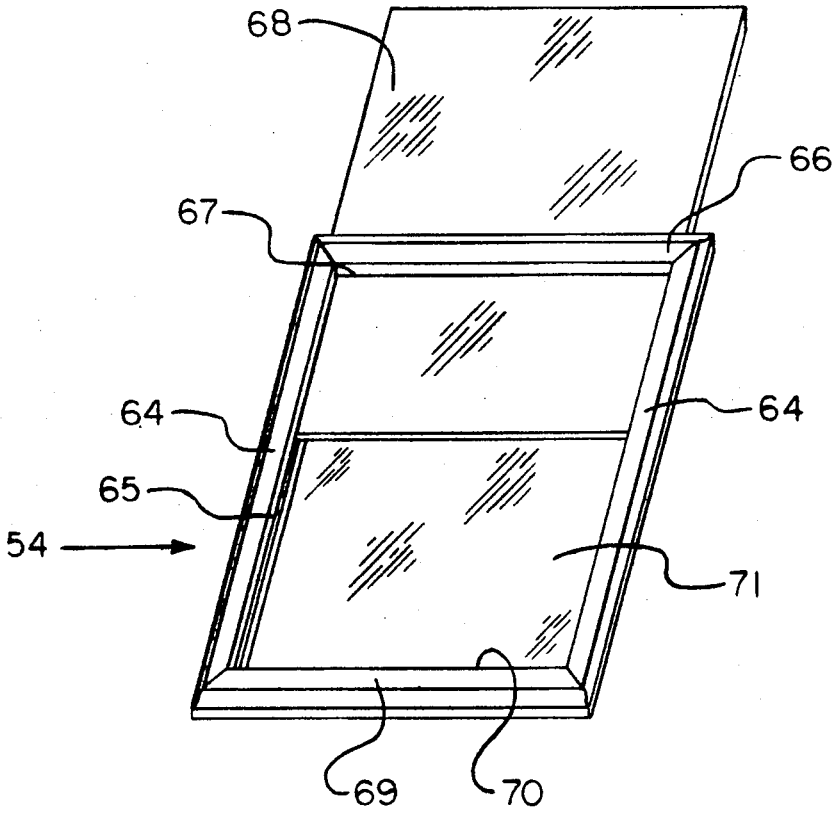
FIG. 9 is a perspective view illustrating a multi-layered puzzle frame.

FIG. 9 illustrates the preferred construction and design of the puzzle frame 54. The puzzle frame 54 is preferably constructed of oak or other dark, sturdy woods which are aesthetically attractive. The present puzzle frame 54 consists of a pair of parallel elongate sides 64 which are grooved 65 lengthwise, along their inner surfaces. One opposing end 66 includes a slot opening 67 therein for the slidable insertion of a clear top transparent material layer 68. The remaining end 69 includes a lengthwise groove 70 which is aligned with the side grooves 65 to retain the top clear transparent material layer 68 and hold the puzzle pieces in place. The base layer 71 of the puzzle frame is constructed to provide standardized puzzle depth depending on the number of intermediate layers used for each puzzle.

Figure 10A:
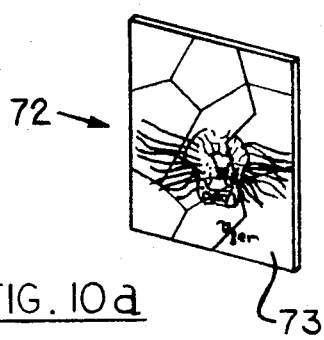
FIGS. 10A and 10B are perspective views illustrating an intermediate layer having designs imprinted on the top and bottom sides of the layer.
Figure 10B:
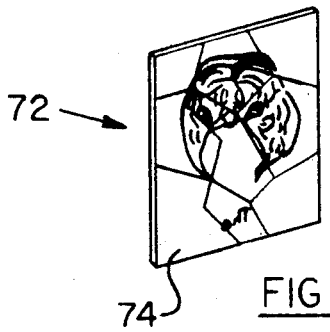

FIGS. 10A and 10B illustrate another variation of the present invention wherein the desired designs are silk screened onto both sides of the intermediate layer 72. This variation adds the further challenge of determining the top or bottom, 73 and 74, for each puzzle piece. In this variation, the designs previously applied to the first and second intermediate layers, 51 and 52 respectively, are applied to the top and bottom surfaces, 73 and 74 respectively, of a single layer to form the modified intermediate layer 72. Additionally, by applying the design to all sides of each intermediate layer, the complexity of each puzzle is multiplied dramatically and results in a challenging puzzle for even the most experienced puzzle enthusiast.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A multi-layered puzzle and frame, comprising a puzzle frame having a base section and a plurality of raised side sections, a plurality of said side sections having an inner groove therein, a generally transparent cover layer, one of said side sections having a slot opening, said cover layer being in slidable communication with said slot opening and said inner grooves of said side sections, a plurality of generally transparent puzzle layers removably positioned within said side sections and between said side section and cover layer, said puzzle layers each consisting of a plurality of irregularly shaped pieces having a portion of a design imprinted thereon, said puzzle layers being generally transparent to create a composite design when said puzzle layers are overlapped, said cover layer being adapted to secure said puzzle layers between said cover layer and said base section for the display of the completed puzzle through said cover layer, and said base section of said frame having a composite design imprinted thereon.

2. The puzzle of claim 1, wherein a plurality of the irregularly shaped pieces have top and bottom surfaces and a plurality of said pieces having a portion of a design imprinted on the top and bottom surfaces of each piece.

* * * * *